US005328076A

United States Patent [19]

Lowell

[11] Patent Number: 5,328,076

[45] Date of Patent: Jul. 12, 1994

[54] STABILIZED CLINCHER FOR STITCHER

[75] Inventor: Kenneth W. Lowell, Bristol, Conn.

[73] Assignee: Pitney Bowes Inc., Stamford, Conn.

[21] Appl. No.: 130,806

[22] Filed: Oct. 4, 1993

[51] Int. Cl.[5] ..... B27F 7/17

[52] U.S. Cl. ..... 227/155

[58] Field of Search ..... 227/154, 155

[56] References Cited

U.S. PATENT DOCUMENTS

| | | | |
|---|---|---|---|
| 694,031 | 2/1902 | Schmidt, Jr. | 227/155 |
| 892,827 | 7/1908 | Graves | 227/155 |
| 1,007,258 | 10/1911 | Walker | 227/155 |
| 2,019,990 | 11/1935 | Newhouse | 227/155 |
| 2,513,276 | 7/1950 | Belluche | 227/155 |
| 3,613,217 | 1/1970 | Perkins | 227/155 |

*Primary Examiner*—Scott Smith
*Attorney, Agent, or Firm*—Charles R. Malandra, Jr.; Melvin J. Scolnick

[57] ABSTRACT

Apparatus for stapling documents. The apparatus includes: a pair of side plates; a stitch head mounting bar secured to the side plates; a clincher mounting bar secured to the side plates; a stitch head mounted on the stitch head mounting bar; a clincher mounted on the clincher mounting bar; a pair of fixture plates secured to the side plates; a clincher actuating bar slidingly engaging the pair of fixture plates; a shaft seated in the fixture plates; a clincher actuating arm rotatably mounted on the shaft and engaging the clincher actuating bar; and a device for rotating the clincher actuating arm whereby the clincher is moved up into clinching position and down away from the clinching position.

5 Claims, 5 Drawing Sheets

STABILIZED CLINCHER FOR STITCHER

BACKGROUND OF THE INVENTION

The instant invention relates to stitching (stapling) apparatus used in document feeding systems, and more particularly to apparatus for stabilizing the clincher in a stitching device.

There are many applications today in which documents are fed along a feed path and then collated for further processing. In many cases the documents must be properly aligned prior to insertion into an envelope. In a significant number of applications, it is necessary that the documents be secured to one another, i.e. stitched or stapled together. There is a universal stitcher that is well known in the art and it is available for a variety of applications in which stapling of documents is required. The stitch is in the form of an open rectangle prior to clinching, i.e., it consists of a top side and two vertical legs extending downwardly from the top side. After clinching, the stitch is in the form of a rectangle that is almost closed on the bottom, i.e., the two legs are bent (clinched) somewhere between their ends so that they face each other and have sections substantially parallel to the top side. The height of the stitch is the difference between the top side and the bent sections of the two legs.

In prior art stitchers, the height of the stitch for a particular collation has varied considerably, resulting in non-uniform stitching which contributes to alignment problems with the documents, and complicates processing downstream of the stitching.

Accordingly, the instant invention provides apparatus in a stitcher which maintains uniform compression of the clinched portion of the stitch and assures uniform height of the stitch.

SUMMARY OF THE INVENTION

Accordingly, the instant invention provides apparatus for stapling documents. The apparatus comprises: a pair of side plates; a stitch head mounting bar secured to the side plates; a clincher mounting bar secured to the side plates; a stitch head mounted on the stitch head mounting bar; a clincher mounted on the clincher mounting bar; a pair of fixture plates secured to the side plates; a clincher actuating bar slidingly engaging the pair of fixture plates; a shaft seated in the fixture plates; a clincher actuating arm rotatably mounted on the shaft and engaging the clincher actuating bar; and means for rotating the clincher actuating arm whereby the clincher is moved up into clinching position and down away from the clinching position.

DETAILED DESCRIPTION OF THE PREFERRED EMBODIMENT

Figure 1:
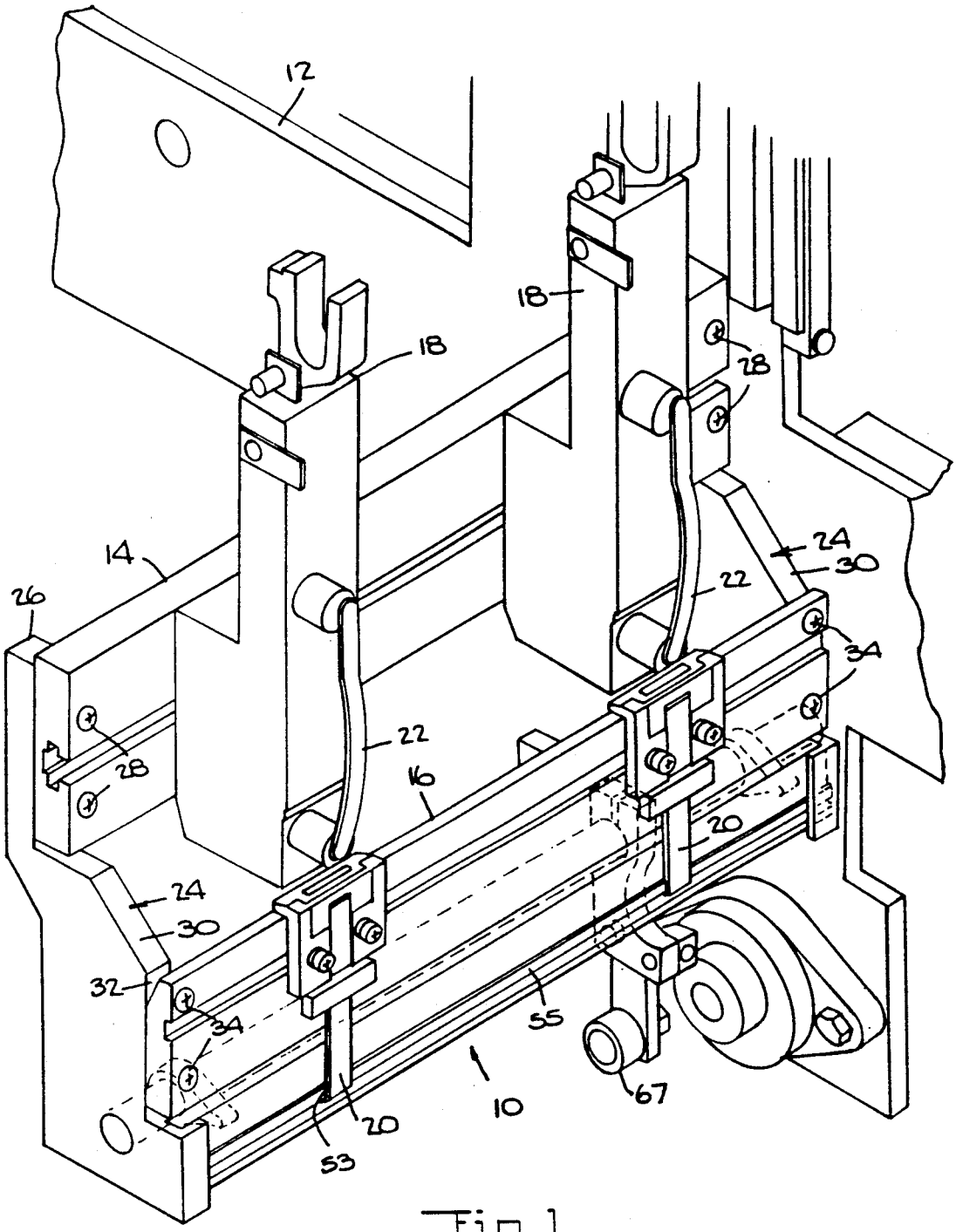
FIG. 1 is a perspective view of a stitching apparatus in accordance with the instant invention.

In describing the preferred embodiment of the instant invention, reference is made to the drawings, wherein there is seen a stitcher generally designated 10 which is employed in many document feeding systems to staple together a collation of documents 11. The stitcher 10 includes a pair of side plates 12 on which are fixedly mounted a stitch head mounting bar 14 and a clincher mounting bar 16. The stitch head mounting bar 14 supports the two stitch heads 18 and the clincher mounting bar 16 supports the two clinchers 20. The stitch head 18 feeds a section of wire 22 through the documents 11 to be stapled (stitched) toward the clincher 20 which bends the ends of the wire 22 to form a staple in a conventional process which is well known.

As seen above, both the stitch head mounting bar 14 and the clincher mounting bar 16 are secured to the side plates 12. A pair of fixturing plates 24 is secured to a side plate 12 and secure the stitch head mounting bar 14 to the clincher mounting bar 16 at the ends thereof. Each fixturing plate 24 is secured to a side plate 12 and includes a vertical, upper section 26 which is secured by screws 28 to the stitch head mounting bar 14, an angled, intermediate section 30 and a lower, vertical section 32 which is secured by screws 34 to the clincher mounting bar 16.

Figure 2:
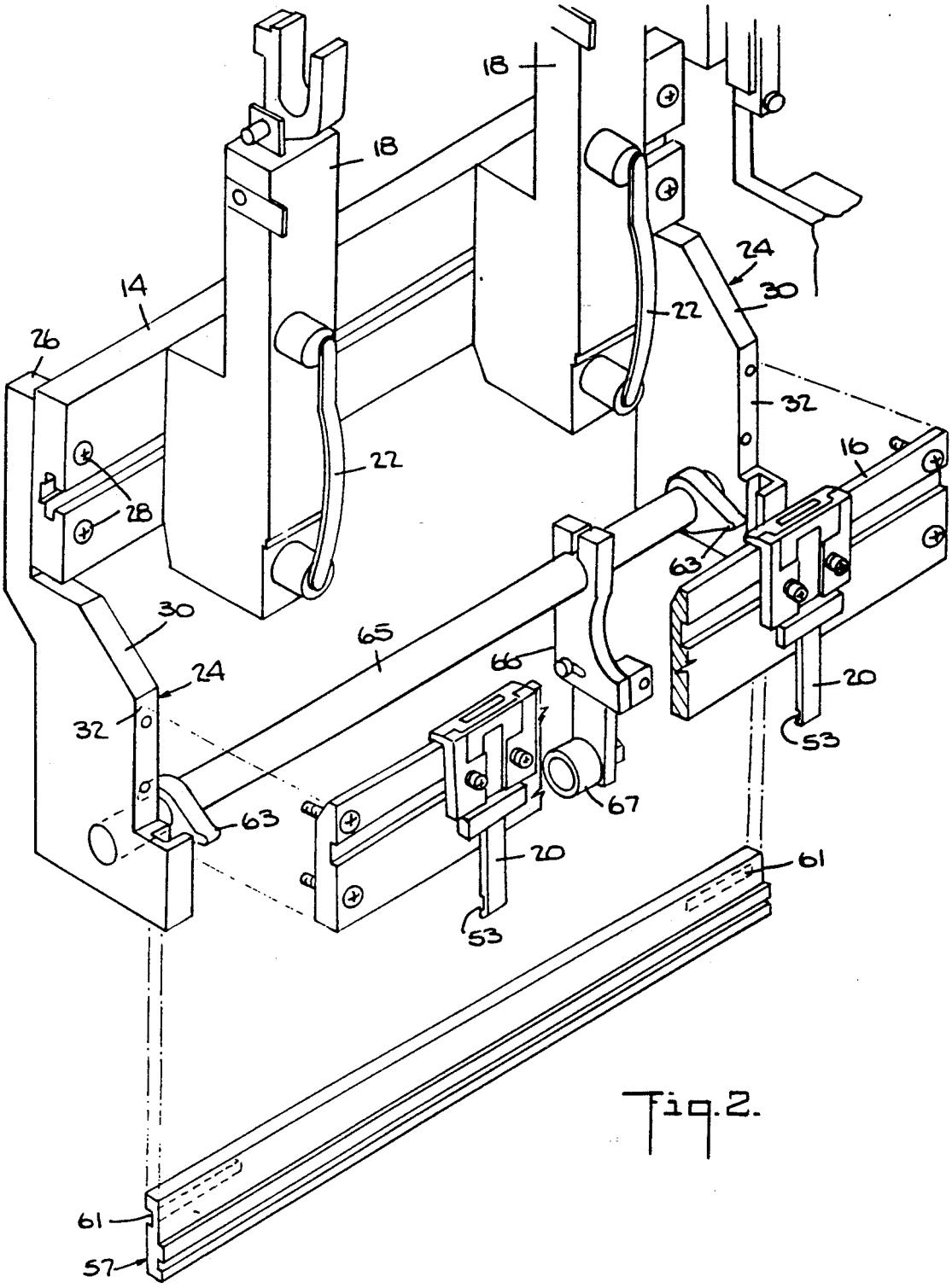
FIG. 2 is an exploded view of the apparatus seen in FIG. 1.
Figure 4:
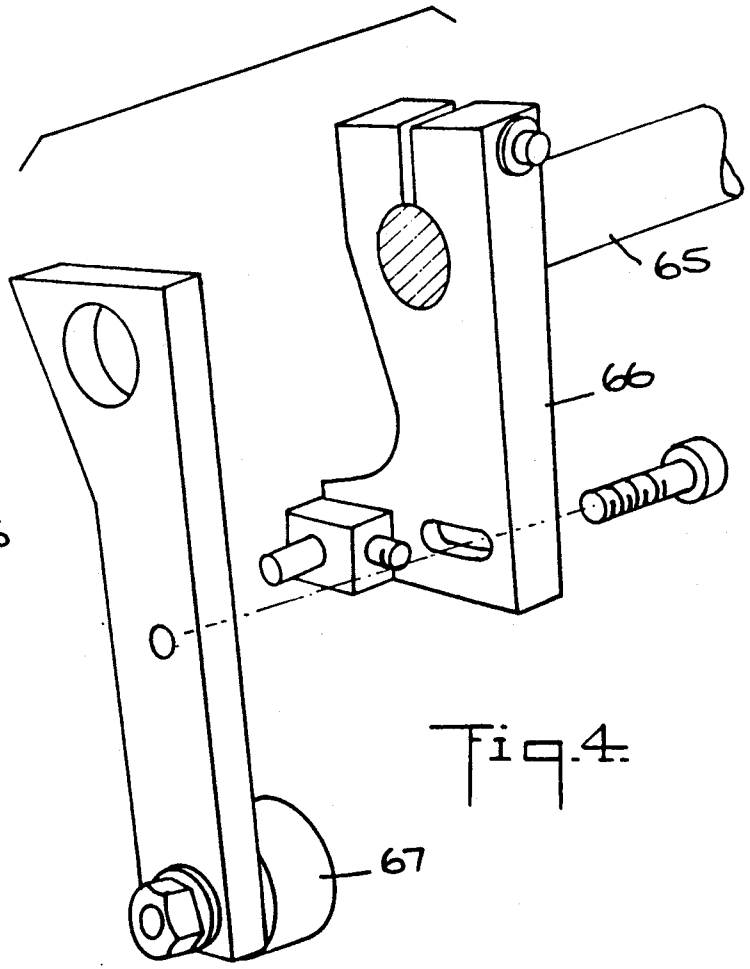
FIG. 4 is an exploded view of the apparatus seen in FIG. 3.
Figure 5:
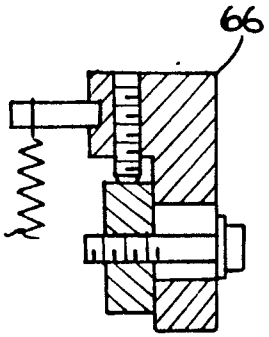
FIG. 5 is a sectional view taken on the plane indicated by the line 5—5 in FIG. 7.
Figure 3:
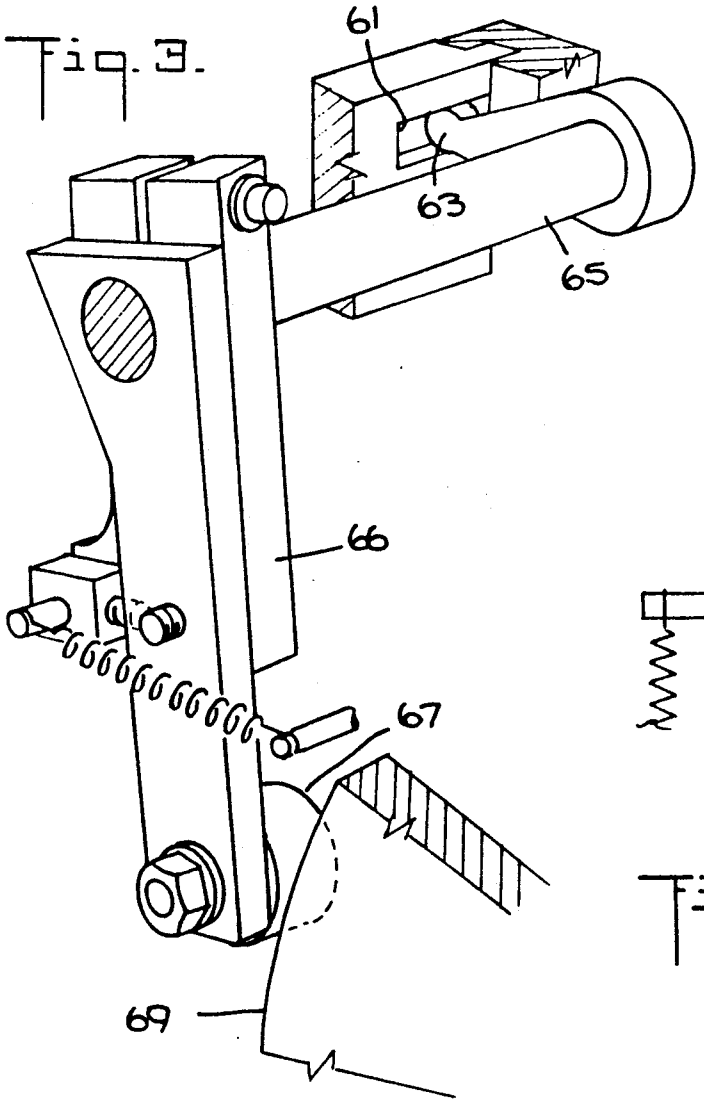
FIG. 3 is a perspective view of the drive linkage for the clincher.

Each clincher 20 is mounted on a bracket 51 which is secured to the clincher mounting bar 16. The bottom of each clincher 20 includes a slot 53 which engages a vertically extending flange 55 of a clincher actuating bar 57 (see FIG. 2). The fixture plates 24 each include a channel 59 for slidingly engaging the clincher actuating bar 57. As best seen in FIG. 3, the clincher actuating bar 57 includes a pair of apertures 61 which engage the ends of a pair of clincher actuating arms 63. Each of the actuating arms 63 is fixedly mounted on a shaft 65 which is seated at its ends in the fixturing plates 24.

Figure 6:
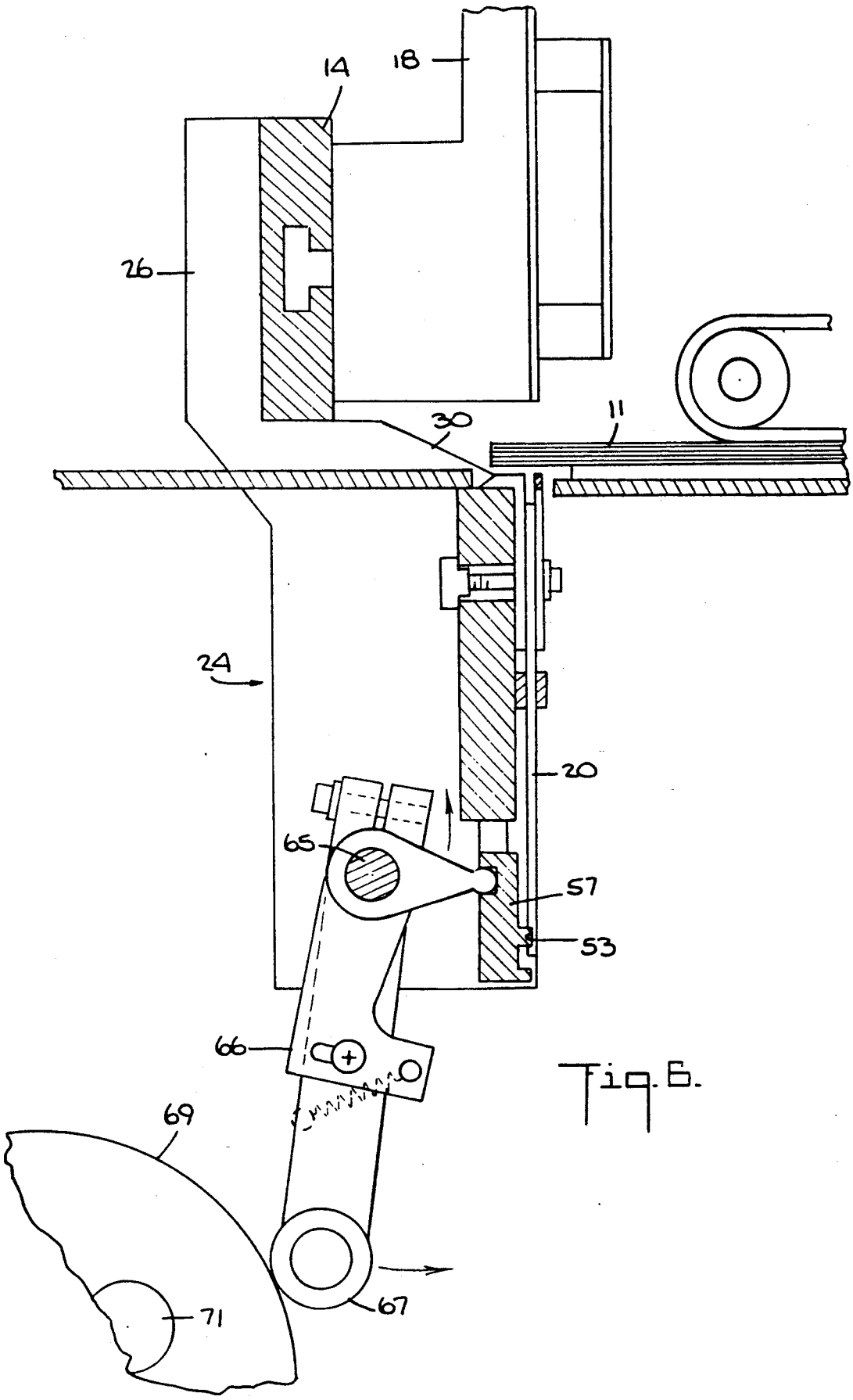
FIG. 6, is a vertical, sectional view of the apparatus seen in FIG. 1 prior to stitching.
Figure 7:
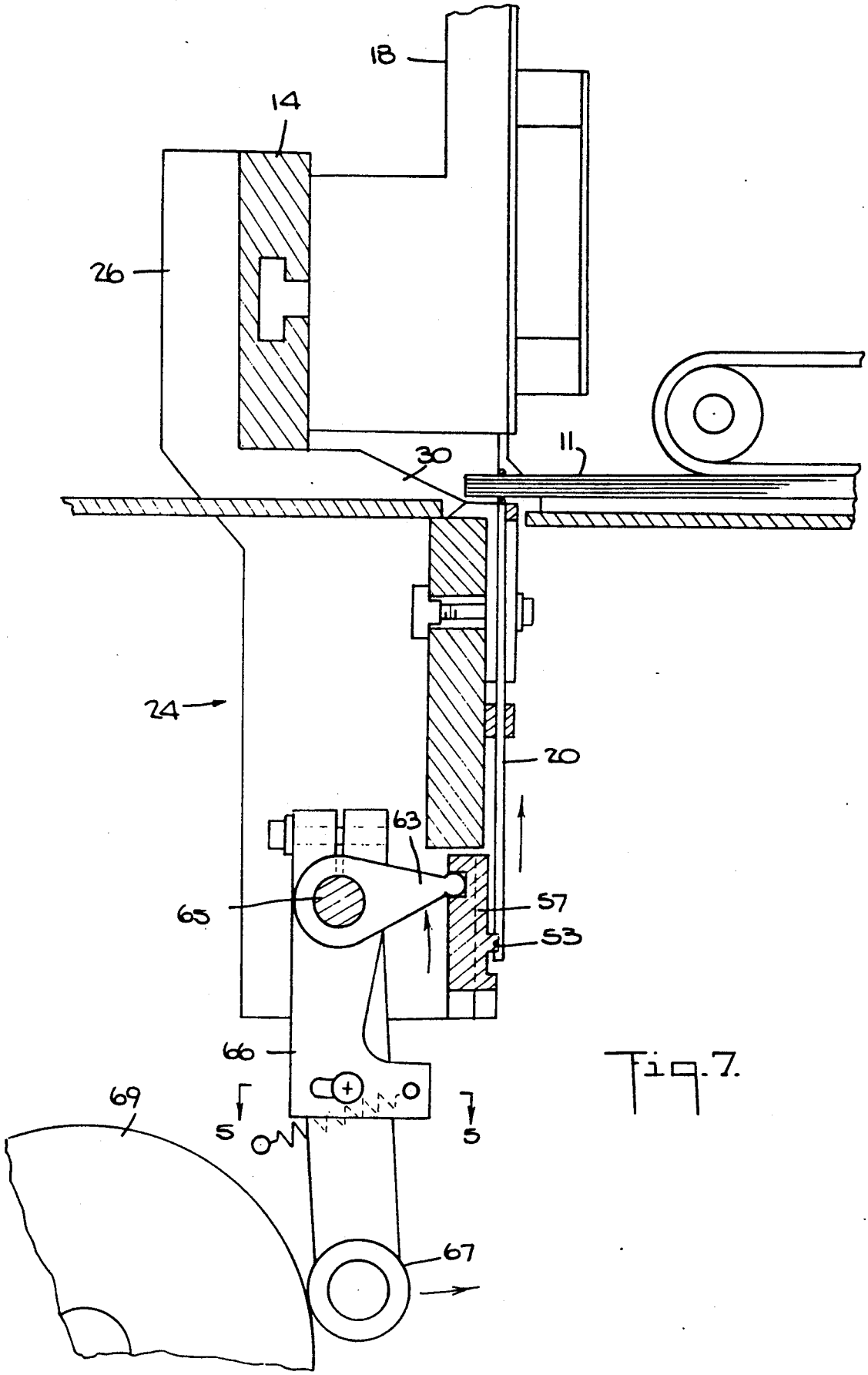
FIG. 7 is similar to FIG. 6 but shows the apparatus immediately after clinching.

Each clincher 20 must be moved up from the position seen in FIG. 6 to the position seen in FIG. 7. The clincher actuating bar 57 is moved upward by the clincher actuating arm 63 which is moved upward by a bracket 66 which is rotated by a cam follower 67. The bracket 66 is secured to the cam follower 67 and the bracket 66 rotates about the shaft 65. The actuating arm 63 is fixedly secured to the bracket 66. The cam follower 67 rides on a cam 69 mounted on a cam shaft 71. Thus, rotation of the cam shaft 71 causes the actuating arm 63 to rotate which moves the actuating bar 57 up and down. Prior to stapling, the actuating bar 57 is down and thus the clinchers 20 are down, as seen in FIG. 6. When stitching is required, the actuating bar 57 is moved up and thus the clinchers 20 are moved up into the positions seen in FIG. 7. In effect, the clinchers 20 are functioning as anvils for the wire sections 22.

It should be understood by those skilled in the art that various modifications may be made in the present invention without departing from the spirit and scope thereof, as described in the specification and defined in the appended claims.

What is claimed is:

1. Apparatus for stapling documents, comprising:

a pair of side plates;

a stitch head mounting bar secured to said side plates;

a clincher mounting bar secured to said side plates;

a stitch head mounted on said stitch head mounting bar;

a clincher mounted on said clincher mounting bar;

a pair of fixture plates secured to said side plates;

a clincher actuating bar slidingly engaging said pair of fixture plates;

a shaft seated in the fixture plates;

a clincher actuating arm rotatably mounted on said shaft and engaging said clincher actuating bar; and means for rotating said clincher actuating arm whereby said clincher is moved up into clinching position and down away from said clinching position.

2. The apparatus of claim 1, wherein said rotating means comprises a bracket secured at one end to said shaft and a cam follower secured to the other end of said bracket.

3. The apparatus of claim 2, additionally comprising a cam engaging said cam follower and wherein rotation of said cam causes said clincher to move up into clinching position and down away from said clinching position.

4. The apparatus of claim 3, wherein said clincher includes a slot and said clincher actuating bar includes a vertically extending flange for engaging said slot.

5. The apparatus of claim 4, wherein said clincher actuating bar includes an aperture for engaging the end of said clincher actuating arm.

* * * * *